US011002043B2

(12) United States Patent
Schuur

(10) Patent No.: US 11,002,043 B2
(45) Date of Patent: May 11, 2021

(54) SECURITY TETHER FOR SKIS OR OTHER OBJECTS

(71) Applicant: Megan Reilly Schuur, Marcellus, MI (US)

(72) Inventor: Megan Reilly Schuur, Marcellus, MI (US)

( * ) Notice: Subject to any disclaimer, the term of this patent is extended or adjusted under 35 U.S.C. 154(b) by 0 days.

(21) Appl. No.: 16/410,470

(22) Filed: May 13, 2019

(65) Prior Publication Data

US 2019/0264471 A1 Aug. 29, 2019

Related U.S. Application Data

(63) Continuation of application No. 15/443,141, filed on Feb. 27, 2017, now abandoned.

(60) Provisional application No. 62/301,356, filed on Feb. 29, 2016.

(51) Int. Cl.

| | |
|---|---|
| ***E05B 73/00*** | (2006.01) |
| ***A63C 11/02*** | (2006.01) |
| ***A45F 3/14*** | (2006.01) |
| ***A45C 13/20*** | (2006.01) |
| ***A63C 11/00*** | (2006.01) |
| ***E05B 37/00*** | (2006.01) |

(52) U.S. Cl.

CPC ..... *E05B 73/0005* (2013.01); *A45C 13/20* (2013.01); *A45F 3/14* (2013.01); *A63C 11/006* (2013.01); *A63C 11/021* (2013.01); *A63C 11/025* (2013.01); *E05B 37/00* (2013.01); *A45F 2003/142* (2013.01)

(58) Field of Classification Search

CPC ..... E05B 73/0005; E05B 37/00; A45C 13/20; A45F 3/14; A45F 2003/142; A63C 11/006; A63C 11/021; A63C 11/025

USPC ..... 224/257

See application file for complete search history.

(56) References Cited

U.S. PATENT DOCUMENTS 5,370,286 A * 12/1994 Newman ..... A45F 3/14 119/857
5,437,401 A * 8/1995 Seltzer ..... A45F 3/02 224/153
5,581,853 A * 12/1996 Miller ..... A61F 5/3761 24/302
5,603,545 A * 2/1997 Benson ..... A45F 3/14 224/250
6,006,555 A * 12/1999 Shu-Fen ..... E05B 67/003 70/18

(Continued)

*Primary Examiner* — Peter N Helvey
(74) *Attorney, Agent, or Firm* — Larry E. Henneman, Jr.; Henneman & Associates, PLC

(57) ABSTRACT

A novel security tether includes an intermediate flexible substrate, a first loop, and a second loop. The first loop is fixed to a first end of the intermediate flexible substrate and is switchable between a closed position and an open position. The first loop further includes a lock to retain the first loop in the closed position when engaged. The second loop is a fixed, closed loop that is coupled to a second end of the intermediate flexible substrate and is configured to allow the first loop to pass therethrough to create a secondary loop to encircle an anchor object. The first loop can be closed around an object to be secured, thereby securing the object to be secured to the anchor object when the lock is engaged. The security tether is conveniently portable and particularly useful for securing skis to an anchor object.

19 Claims, 7 Drawing Sheets

(56) References Cited

U.S. PATENT DOCUMENTS 6,049,953 A * 4/2000 McCay ..... F16B 45/00 24/302
6,401,502 B1 * 6/2002 Yang ..... E05B 67/003 70/14
6,430,973 B1 * 8/2002 Huang ..... B62H 5/003 70/18
6,447,037 B1 * 9/2002 Crouch ..... B65D 33/14 294/149
6,457,762 B1 * 10/2002 Garutti ..... A63C 11/006 224/257
6,637,077 B2 * 10/2003 Doty ..... B60P 3/079 24/298
6,742,366 B1 * 6/2004 Lai ..... E05B 37/025 70/30
6,772,485 B2 * 8/2004 Alpert ..... A45C 13/30 190/102
7,000,809 B1 * 2/2006 Stroud ..... A45F 5/02 224/250
8,616,600 B2 * 12/2013 Owen ..... A63C 11/025 224/917
8,746,769 B2 * 6/2014 Owen ..... A63C 11/021 224/917
8,905,275 B1 * 12/2014 Klein ..... A63C 11/025 224/250
D737,667 S * 9/2015 Moreau ..... D8/358
D737,668 S * 9/2015 Moreau ..... D8/358
9,635,925 B2 * 5/2017 Moreau ..... A45F 5/021
9,816,296 B2 * 11/2017 Denny ..... E05B 73/0005
2003/0173382 A1 * 9/2003 Robinson ..... A45F 3/14 224/259
2004/0094586 A1 * 5/2004 MacAllister ..... A45F 3/14 224/258
2004/0159687 A1 * 8/2004 Eliason ..... A45F 3/14 224/150
2004/0182899 A1 * 9/2004 Deutchman ..... B60R 11/06 224/410
2005/0000470 A1 * 1/2005 Fountoulakis ..... A01K 27/005 119/769
2005/0199018 A1 * 9/2005 Chen ..... E05B 67/003 70/18
2005/0235710 A1 * 10/2005 Ling ..... E05B 73/0082 70/58
2005/0262904 A1 * 12/2005 Ling ..... E05B 67/003 70/49
2006/0076378 A1 * 4/2006 Hall ..... A45F 3/14 224/257
2006/0207302 A1 * 9/2006 Yu ..... E05B 37/025 70/58
2006/0219744 A1 * 10/2006 Spadaccini ..... A45F 3/14 224/257
2007/0114255 A1 * 5/2007 Spadaccini ..... A63C 11/025 224/257
2008/0072633 A1 * 3/2008 Samuel ..... E05B 73/0005 70/58
2011/0056051 A1 * 3/2011 Wilkinson ..... H02G 3/30 24/302
2015/0033510 A1 * 2/2015 Nagi ..... A45F 3/14 24/302
2016/0095420 A1 * 4/2016 Moreau ..... A45F 5/021 248/341
2016/0095421 A1 * 4/2016 Moreau ..... A45F 5/00 248/341

* cited by examiner

SECURITY TETHER FOR SKIS OR OTHER OBJECTS

CROSS-REFERENCE TO RELATED APPLICATIONS

This application is a continuation of co-pending U.S. patent application Ser. No. 15/443,141, filed on Feb. 27, 2017 by the same inventor, which claims the benefit of U.S. Provisional Patent Application Ser. No. 62/301,356, filed Feb. 29, 2016 by the same inventor, each of which is incorporated by reference herein in its entirety.

BACKGROUND OF THE INVENTION

Field of the Invention

This invention relates generally to security devices, and more particularly to security devices for temporarily securing objects to stationary anchor objects.

Description of the Background Art

Ski resorts typically have storage areas (e.g., ski racks, lockers, etc.) for storing skis and other related equipment while guests are taking a break (e.g., having lunch, using the restroom, etc.) from skiing. During this time, such equipment is vulnerable to theft. It is, therefore, desirable to secure such equipment in place during breaks.

There are many securing devices available. For example, padlocked chains can be used to lock ski equipment to stationary objects (i.e. ski racks). As another example, some ski racks include locking mechanisms.

Although many securing devices exist, they have disadvantages. For example, padlocked chains are heavy and inconvenient for the skier to carry when not in use. Furthermore, padlocked chains are relatively expensive. As another example, locking ski racks are expensive and, therefore, are not always available at many ski resorts.

What is needed, therefore, is a device for securing ski equipment and other equipment to stationary objects that is more convenient to carry, less expensive than current devices, and usable where locking ski racks are not available.

SUMMARY

The present invention overcomes the problems associated with the prior art by providing a lightweight portable security tether. The invention facilitates locking valuable items to stationary anchor objects.

The security tether includes an intermediate flexible substrate, a first loop, and a second loop. The first loop is fixed to a first end of the intermediate flexible substrate and is switchable between a closed position and an open position. The first loop also includes a lock to retain the first loop in the closed position when engaged. The second loop is a fixed, closed loop coupled to a second end of the intermediate flexible substrate opposite the first end. The second loop is configured to allow the first loop to pass therethrough to create a secondary loop to encircle an anchor object. The first loop can be closed around an object to be secured, thereby securing the object to be secured to the anchor object when the lock is engaged.

In a particular embodiment, the security tether further includes a set of instructions to a user. For example, the instructions can include indicia describing a process for securing the object to be secured to the anchor object. In one exemplary embodiment, the instructions are affixed to the intermediate flexible substrate. Exemplary instructions can instruct the user to position the intermediate flexible substrate around at least a portion of an anchor object, to pass the first loop through the second loop thereby attaching the intermediate substrate to the anchor object, to position the first loop around an object to be secured, and to engage/lock the lock.

In another particular embodiment, the intermediate flexible substrate includes a cord.

In yet another particular embodiment, the intermediate flexible substrate includes a strap. In a more particular embodiment, the intermediate flexible substrate, the first loop, and the second loop are formed from a single unitary strap. In another more particular embodiment, the intermediate flexible substrate is formed from woven nylon. In an alternative embodiment, the intermediate flexible substrate is formed from a woven aramid such as, for example, Kevlar.

In a particular embodiment, the lock is a number combination lock. In a more particular embodiment, the number combination lock is an insert buckle. In an alternative embodiment, the lock is a key lock.

In another particular embodiment, the first loop is formed by fastening the second end of the intermediate flexible substrate to the intermediate flexible substrate via stitching. In some embodiments, grommets can be used in place of, or in combination with, the stitching.

In one embodiment, the security tether functions as a sling for carrying a pair of stacked skis. In a more particular embodiment, the first loop is adapted to receive a first end of the pair of stacked skis, and the second loop is adapted to receive an opposite second end of the pair of stacked skis.

A method for manufacturing a security tether is also disclosed. The method includes the steps of providing an intermediate flexible substrate, forming a first loop fixed to a first end of the intermediate flexible substrate, and forming a second fixed, closed loop coupled to a second end of the intermediate flexible substrate opposite the first end. The first loop is switchable between a closed position and an open position and includes a lock to retain the first loop in the closed position when engaged. The second loop is configured to allow the first loop to pass therethrough to create a secondary loop to encircle an anchor object. The first loop is also closable around an object to be secured, thereby securing the object to be secured to the anchor object when the lock is engaged.

A particular method further includes providing instructions including indicia of a process for securing the object to be secured to the anchor object. A more particular method includes affixing the instructions to the security tether.

The security tethers of the invention thus include means for selectively fastening the first loop around an object to be secured, thereby securing the object to be secured to an anchor object.

BRIEF DESCRIPTION OF THE DRAWINGS

The present invention is described with reference to the following drawings, wherein like reference numbers denote substantially similar elements.

DETAILED DESCRIPTION

The present invention overcomes the problems associated with the prior art by providing a lightweight security tether for locking an object to a stationary anchor object. In the following description, numerous specific details are set forth (e.g., substrate materials, fastening means, objects to be secured, etc.) in order to provide a thorough understanding of the invention. Those skilled in the art will recognize, however, that the invention may be practiced apart from these specific details. In other instances, details of well-known manufacturing practices (e.g., stitching of materials, applying grommets, etc.) and components have been omitted, so as not to unnecessarily obscure the present invention.

Figure 1A:
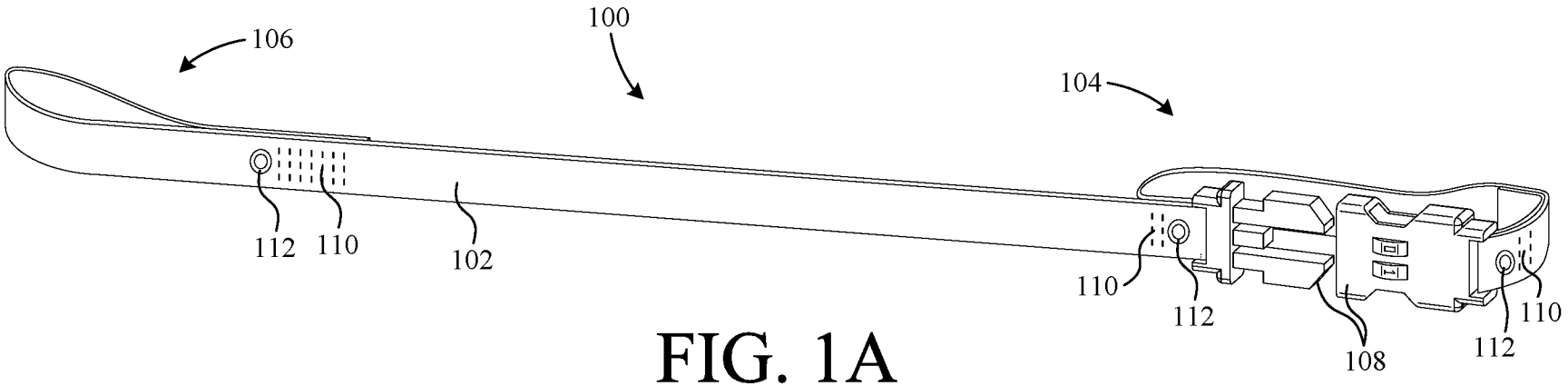
FIG. 1A is a perspective view of a security tether in an open position.
Figure 1B:
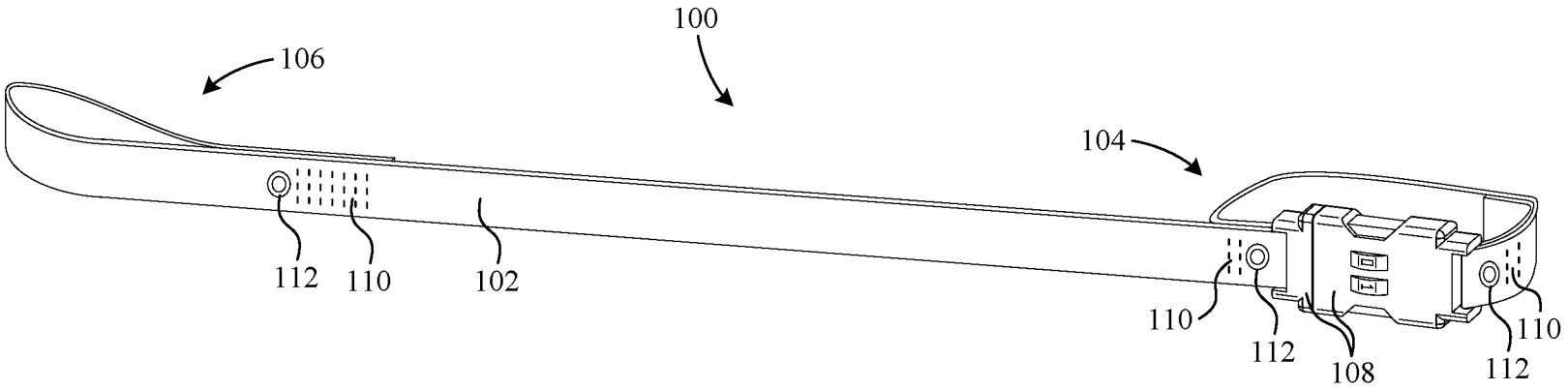
FIG. 1B is a perspective view of the security tether of FIG. 1A in a locked position.

FIGS. 1A and 1B show perspective views of a security tether 100 in an open unlocked position and a closed locked position, respectively. Tether 100 is a portable anti-theft device that is adapted to lock valuable items to stationary anchor objects (e.g., poles, bicycle racks, ski racks, telephone poles, etc.). The design of tether 100 is such that it is lightweight and small, thus making it ideal for carrying in a pocket when not in use, even for a child.

Tether 100 includes an intermediate flexible substrate 102, a first loop 104, and a second loop 106. In this example, substrate 102, first loop 104, and second loop 106 are formed from a unitary woven nylon strap. First loop 104 is formed at a first end of substrate 102 and includes a combination locking insert buckle 108, which allows loop 104 to be fastened and locked around objects. Second loop 106 facilitates the mounting of tether 100 to anchor objects. Furthermore, second loop 106 is formed by permanently fastening the second end of substrate 102 in a looped fashion via stitching 110 and a grommet 112 (e.g., a metal grommet). Likewise, stitching 110 and grommets 112 are used to permanently fasten buckle 108 to substrate 102.

In the example embodiment, first loop 104, second loop 106, and substrate 102 are formed from a single length of weather resistant nylon material. In alternative embodiments, first loop 104, second loop 106, and intermediate strap 102 can be formed separately and assembled. In alternate embodiments the first loop 104, second loop 106, and/or substrate 102 can be formed from any of a variety of materials (e.g., canvas, woven aramid, steel reinforced fabric, rope, steel cable, etc.) sufficiently light to maintain the convenient portability of tether 100. Additionally, first loop 104, second loop 106, and substrate 102 can be any of a variety of colors or patterns (e.g. fluorescent orange, rainbow, etc.) and can be embroidered or otherwise altered to provide improved functionality or aesthetics. Thus, tether 100 can be customized, based on the preferences of a user, allowing the user to easily distinguish their own skis from many others that might be on a rack at any given time.

Figure 2:
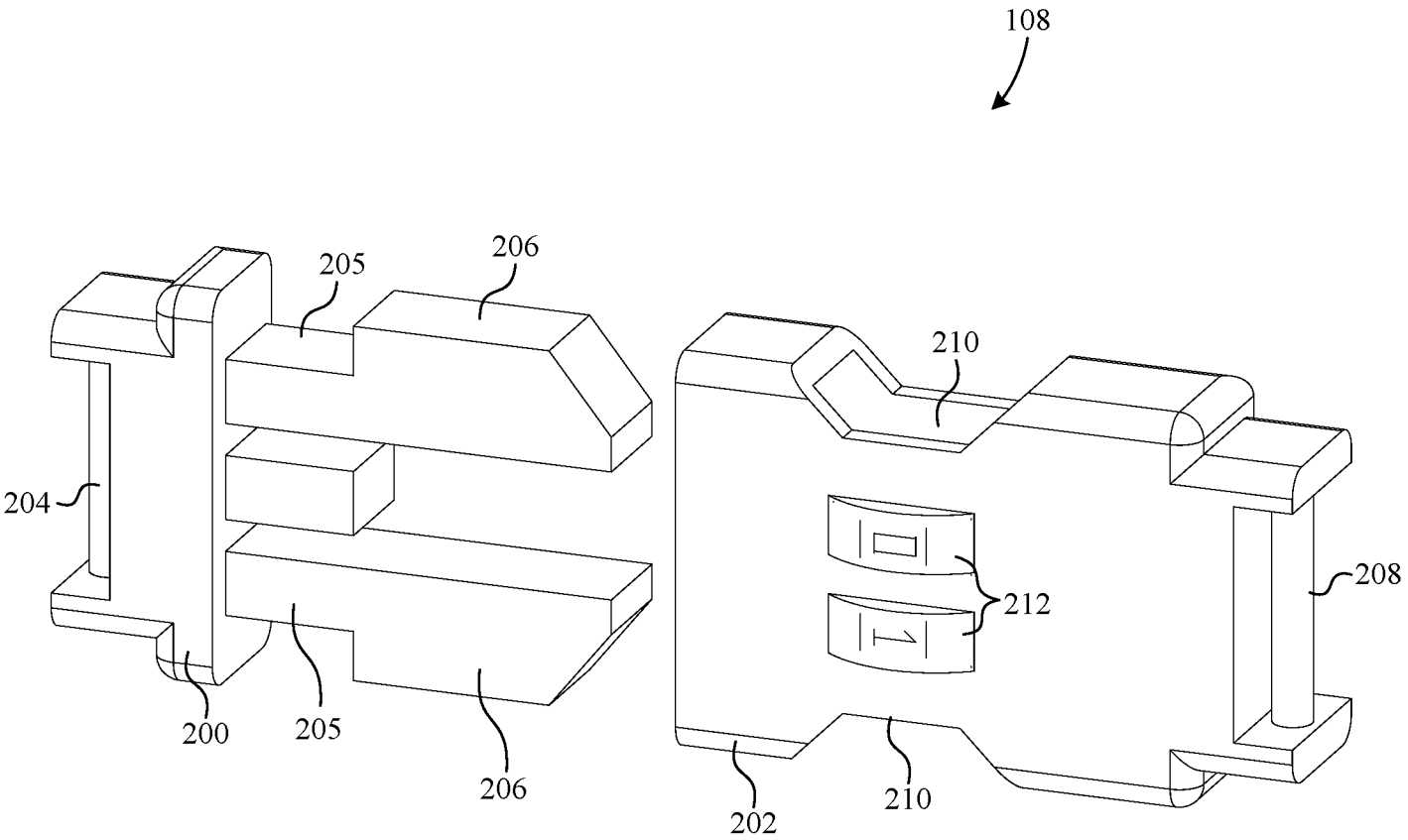
FIG. 2 is a perspective view of a combination locking insert buckle of the security tether of FIGS. 1A-1B.

FIG. 2 shows a perspective view of combination locking insert buckle 108 in an open position. Buckle 108 includes a male component 200 and a complimentary female component 202. Male component 200 includes a strap receiving end 204 through which substrate 102 is routed and then secured via stitching 110 and grommet 112. Male component 200 also includes a set of prongs 205, each of which includes a tab (projection) 206. Prongs 205 are inserted into female component 202 upon closing loop 104.

Female component 202 includes a strap receiving end 208 through which substrate 102 is routed and then secured via stitching 110 and grommet 112. Furthermore, female component 202 includes a set of side cutouts (receivers) 210 and a set of number wheels 212. Cutouts 210 receive and seat tabs 206 when buckle 108 is in the closed position. Additionally, cutouts 210 allow access to tabs 206 when male component 200 is inserted into female component 202.

To close buckle 108, male component 200 is inserted into complimentary female component 202, such that tabs 206 are engaged with cutouts 210. Prongs 205 are flexible and provide a biasing force to maintain the engagement between tabs 206 and side cutouts 210. Buckle 108 can be opened when a user applies an inward force to (e.g., pinches) tabs 206, thus unengaging tabs 206 and side cutouts 210 and allowing male component 200 to slide out of female component 202. However, female component 202 will only permit tabs 206 to be squeezed together if number wheels 212 are aligned to the proper combination which, in this example, is the number combination "01". Otherwise, male component 200 remains locked into female component 202, thus locking loop 104.

In the example embodiment, buckle 108 is a two number combination lock. In alternative embodiments, a three, four, etc. number lock, or a letter combination lock could be substituted for buckle 108. In addition, buckle 108 could be replaced with a keyed lock or any other type of lock that is lightweight and prevents buckle 108 from being opened by anyone without the key/combination. Thus, buckle 108 provides means for selectively fastening the first loop around an object to be secured.

Figure 3:
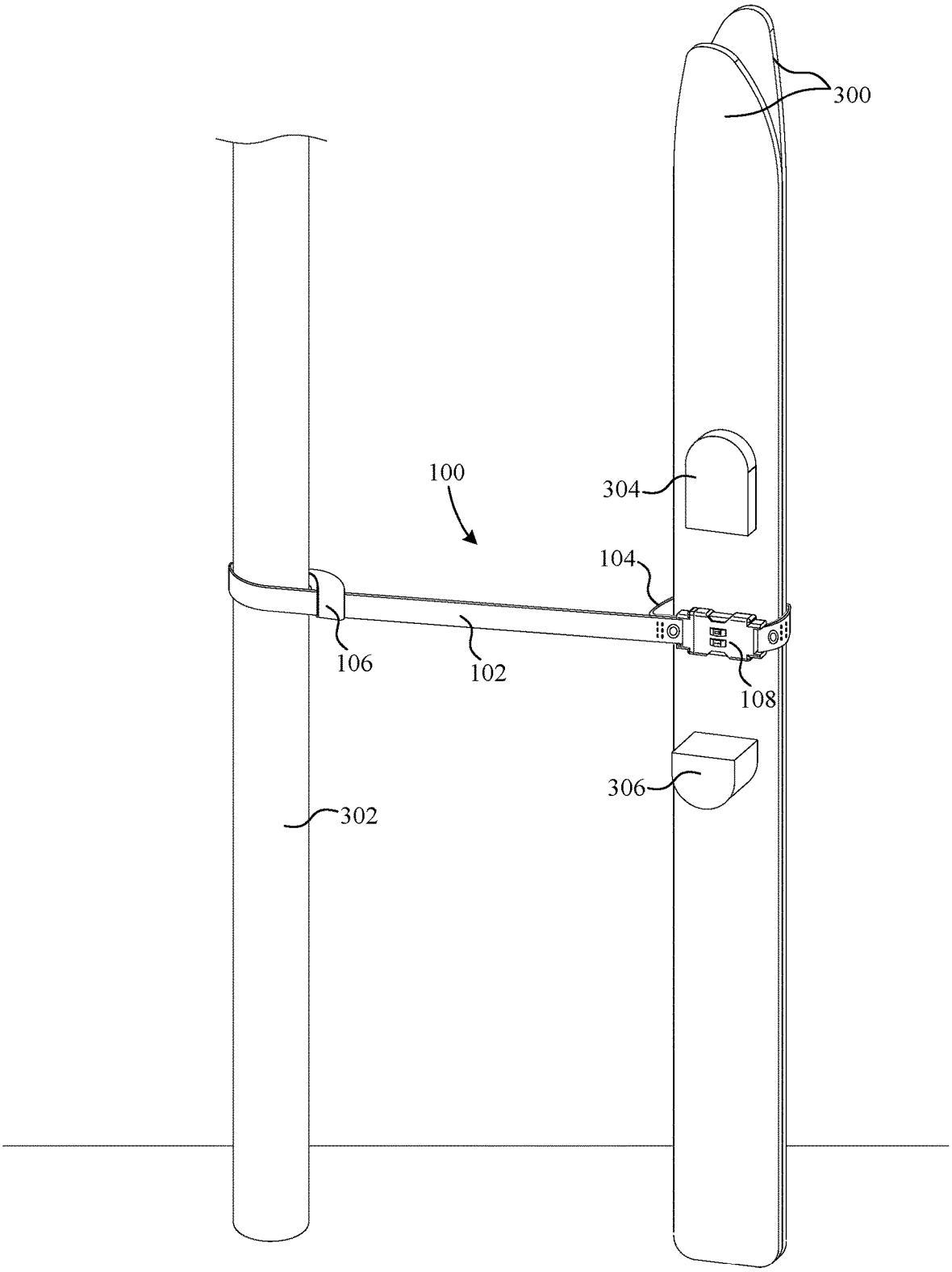
FIG. 3 is a perspective view of a pair of skis secured to an anchor object via the security tether of FIGS. 1A-1B in a first configuration.

FIG. 3 is a perspective view of tether 100 locking a pair of skis 300 to an anchor object via a girth hitch configuration. In this example, the anchor object is a pole 302. Each of skis 300 includes a front binding 304 and a rear binding 306. In this example, pole 302 is a pole permanently anchored into the ground and has a height sufficient to prevent a would-be-thief from sliding tether 100 up and off pole 302.

The locking of skis 300 to pole 302 via tether 100 using the girth hitch configuration is described as follows. First, substrate 102 is wrapped partially around pole 302. Then, loop 104 is pulled through loop 106 thereby fastening tether 100 to pole 302 in the girth hitch configuration as shown. Next, loop 104 is unlocked and opened. Loop 104 is then wrapped around skis 300 (positioned in the bottom-to-bottom configuration shown), and buckle 108 is fastened by inserting male component 200 into female component 202 (shown in FIG. 2) and locked. Buckle 108 remains locked around skis 300 and cannot be opened as long as the number wheels 212 show a combination other than the opening combination ("01" in this example). Additionally, tether 100 cannot be removed without knowing the proper combination because the inner diameter of loop 104 is too small for either of bindings 304 or 306 to fit through.

Figure 4:
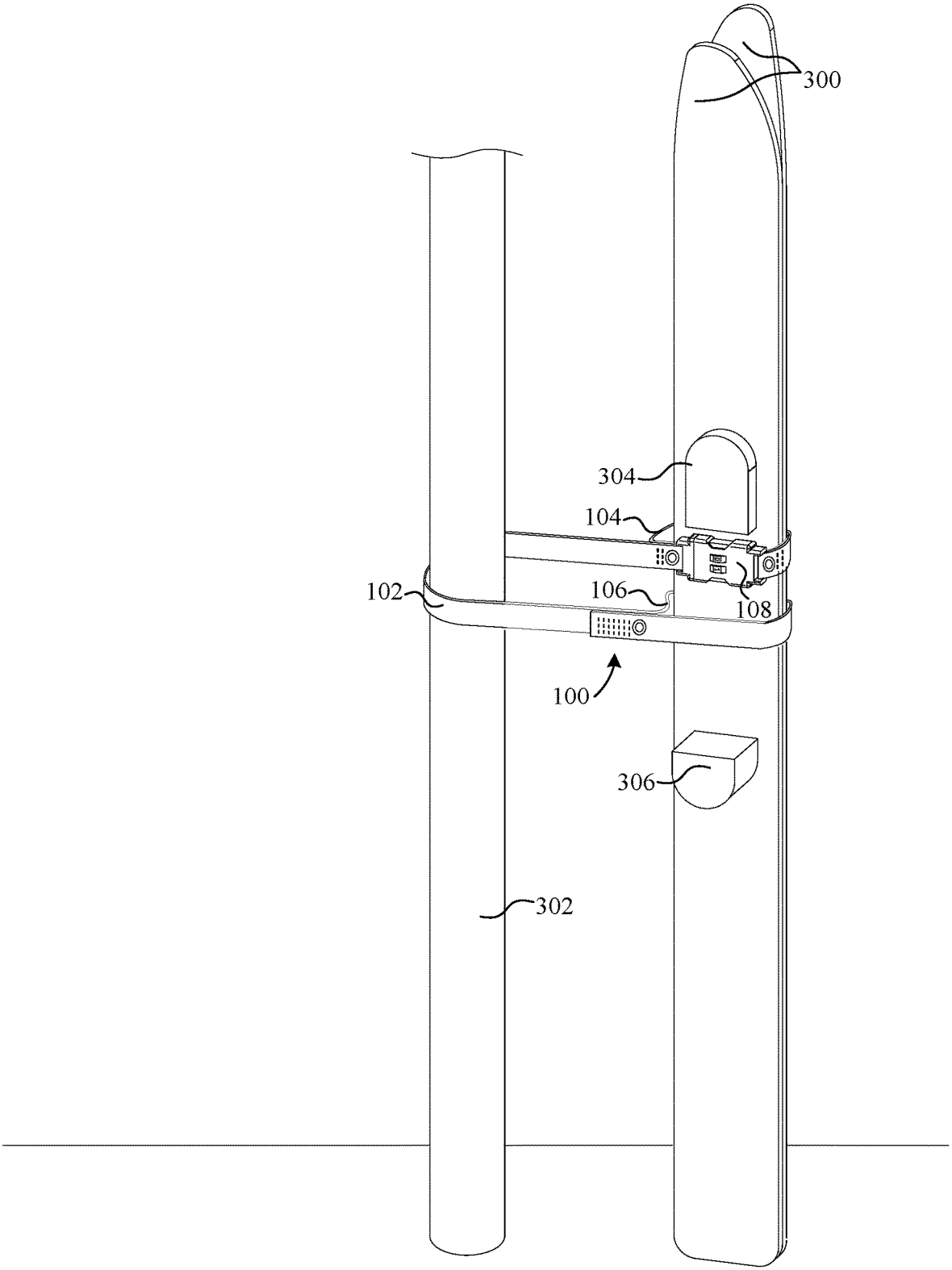
FIG. 4 is a perspective view of a pair of skis secured to an anchor object via the security tether of FIGS. 1A-1B in a second configuration.

FIG. 4 is a perspective view of tether 100 shown locking skis 300 to pole 302 via an alternative configuration.

The locking of skis 300 to pole 302 via tether 100 using the alternative configuration shown in FIG. 4 is described as follows. First, the tops of skis 300 are inserted through loop 106, and loop 106 is positioned between bindings 304 and 306. It is important to recognize that bindings 304 are small enough to fit through loop 106, but bindings 306 are too large to fit through loop 106. Once loop 106 is positioned as shown, substrate 102 is wrapped around pole 302. Then, loop 104 is buckled around skis 300 between loop 106 and front binding 304. In this configuration, tether 100 cannot be removed from pole 302 without knowing the proper combination because loop 106 is too small to pass downward over rear bindings 306 and cannot pass freely upward over loop 104 without being stopped by substrate 102.

Figure 5:
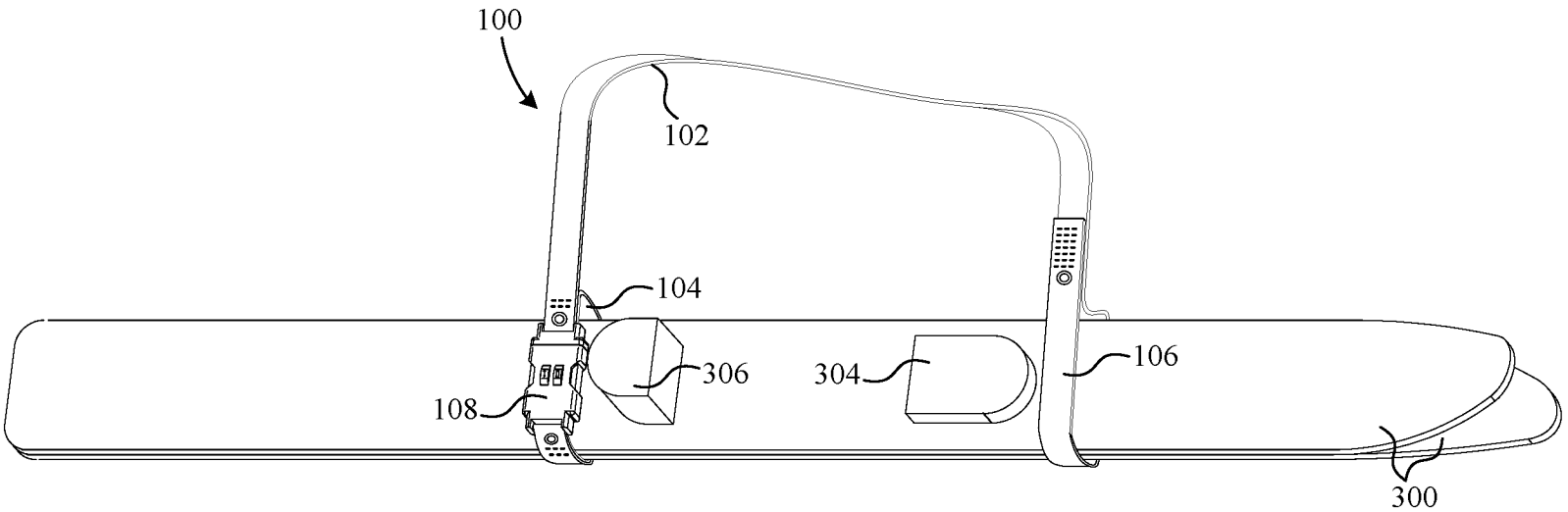
FIG. 5 is a perspective view the security tether of FIGS. 1A-1B being used as a sling.

FIG. 5 is a perspective view of tether 100 configured to be used as a sling to carry skis 300. As shown, loop 104 is buckled around skis 300 behind bindings 306 and loop 106 is positioned around skis 300 forward of bindings 304. In this configuration, tether 100 can be conveniently used to carry the weight of skis 300 on the shoulder (e.g., with the curved ends inclined slightly upward). Additionally, the length of tether 100 can be made short enough to prevent it from slipping off of either end of skis 300 when tether 100 is used in sling mode. Furthermore, whether or not tether 100 will be used with adult skis or child skis can be a factor in determining a suitable length. For example, tether 100 can be made in a shorter version for use with child skis and in a longer version for use with adult skis.

Figure 6:
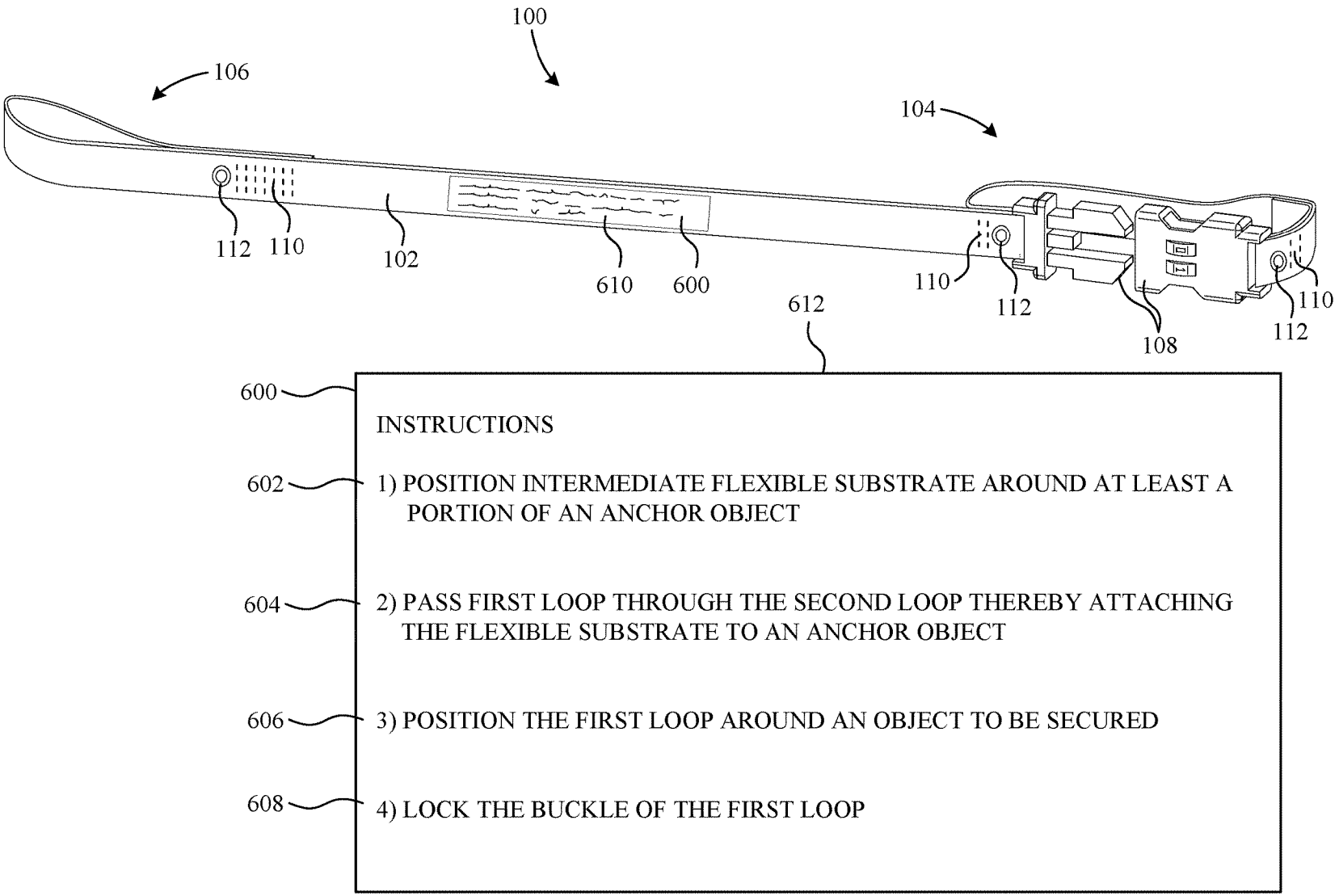
FIG. 6 is a perspective view of the security tether of FIGS. 1A-1B further including operating instructions.

FIG. 6 is a perspective view of tether 100 further comprising instructions 600 describing its use. Instructions 600 include indicia (e.g., written instructions, pictures, graphics, etc.) that describe a process for securing an object to an anchor object using tether 100. In FIG. 6, instructions 600 comprise a plurality of steps, including a first step 602, a second step 604, a third step 606, and a fourth step 608. First step 602 instructs a user to position the intermediate flexible substrate around at least a portion of an anchor object. Second step 604 instructs the user to pass the first loop through the second loop thereby attaching the intermediate substrate to the anchor object. Third step 606 instructs the user to position the first loop around an object to be secured. The fourth step 608 instructs the user to lock the buckle. While steps 602-608 describe instructions for using the girth hitch configuration of FIG. 3, instructions can be provided that describe any method of use described herein or developed in the future.

Instructions 600 can be provided with security tether 100 in various ways. For example, instructions 600 can be formed on a label 610 that is then affixed to a portion of security tether 100, such as substrate 102, by sewing, gluing, etc. Indeed, instructions 600 can even be printed directly on substrate 102. Alternatively or additionally, instructions 600 can be printed on an insert 612 that is included in packaging with security tether 100. As still another option, instructions 600 can be printed on a tag that is attached to security tether 100, for example, by sewing or with a plastic tie.

Figure 7:
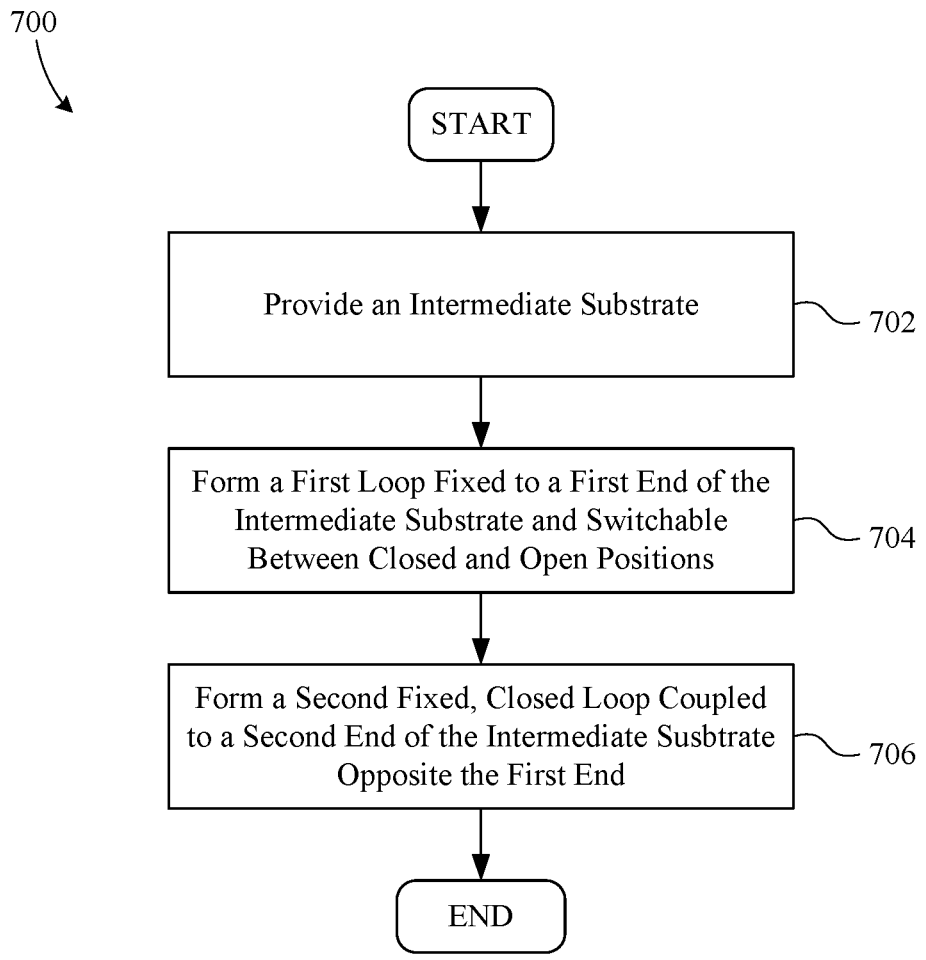
FIG. 7 is a flowchart summarizing a method of manufacturing a security tether of the invention.

FIG. 7 is a flowchart summarizing an exemplary method 700 for manufacturing a security tether according to the present invention. In a first step 702, an intermediate flexible substrate is provided. In a second step 704, a first loop is formed that is fixed to a first end of the intermediate flexible substrate, is switchable between a closed position and an open position, and includes a lock configured to retain the first loop in the closed position when engaged. In a third step 706, a second fixed, closed loop is formed and is coupled near a second end of the intermediate flexible substrate opposite the first end. The second loop is configured to allow the first loop to pass therethrough to create a secondary loop to encircle an anchor object. The first loop can be closed around an object to be secured, thereby securing the object to the anchor object when the lock is engaged.

The description of particular embodiments of the present invention is now complete. Many of the described features may be substituted, altered or omitted without departing from the scope of the invention. For example, alternative intermediate substrate types (e.g., woven Kevlar strap, braided rope, steel cable, reinforced rope, etc.), may be substituted for the woven nylon strap. As another example, alternative locking devices (e.g. key locks) may be substituted for the number combination locking buckle. These and other deviations from the particular embodiments shown will be apparent to those skilled in the art, particularly in view of the foregoing disclosure.

I claim:

1. A method for securing a pair of skis to an anchor object, said method comprising:

providing a security tether including an intermediate flexible substrate, a first loop fixed to a first end of said intermediate flexible substrate, said first loop having a fixed size and being switchable between a closed position and an open position, and including a lock to retain said first loop in said closed position when engaged, said lock requiring a key to open, and a second fixed, closed loop coupled to a second end of said intermediate flexible substrate opposite said first end;

wrapping said intermediate flexible substrate around said anchor object;

passing said first loop through said second loop to create a secondary loop encircling said anchor object;

positioning said pair of skis with a bottom surface of a first ski of said pair of skis abutting a bottom surface of a second ski of said pair of skis, each of said skis including a front binding and a rear binding; and locking said first loop around said pair of skis between said front bindings and said rear bindings, said first loop being too small to slide over said front bindings or said rear bindings, thereby securing said object to said anchor object.

2. The method of claim 1, wherein said lock includes:

a fastener; and a complementary fastener configured to selectively engage and disengage said fastener to close and open said first loop; and wherein said intermediate flexible substrate, said first loop, and said second loop are formed from a same, single unitary strap;

said fastener is fixed to a first end of said unitary strap; and said complementary fastener is coupled to said unitary strap at a fixed position a spaced distance from said fastener.

3. The method of claim 1, wherein said pair of skis is too large to fit through said second loop.

4. The method of claim 1, wherein said intermediate flexible substrate includes a cord.

5. The method of claim 1, wherein said intermediate flexible substrate includes a strap.

6. The method of claim 5, wherein said intermediate flexible substrate, said first loop, and said second loop are formed from a single unitary strap.

7. The method of claim 5, wherein said intermediate flexible substrate is formed from woven nylon.

8. The method of claim 5, wherein said intermediate flexible substrate is formed from a woven aramid.

9. The method of claim 1, wherein:

said lock comprises a combination lock; and said key is the combination to said lock.

10. The method of claim 9, wherein said combination lock comprises an insert buckle.

11. The method of claim 1, wherein said key is a mechanical key.

12. The method of claim 1, wherein said second loop includes said second end of said intermediate flexible substrate stitched to another part of said intermediate flexible substrate.

13. The method of claim 1, wherein said second loop includes said second end of said intermediate flexible substrate fastened to another part of said intermediate flexible substrate by a grommet.

14. The method of claim 1, further comprising:

removing said security tether from said pair of skis and said anchor object;

positioning a first portion of said pair of skis through said second loop;

locking said first loop around a second portion of said pair of skis; and carrying said pair of skis using said intermediate flexible substrate.

15. A method for securing a pair of skis to an anchor object, each ski of said pair of skis including a front binding and a rear binding, said method comprising:

providing a security tether including an intermediate flexible substrate, a first loop fixed to a first end of said intermediate flexible substrate, said first loop having a fixed size and being switchable between a closed position and an open position, and including a lock to retain said first loop in said closed position when engaged, said size of said first loop being large enough to wrap around a pair of skis between front bindings and rear bindings of said skis, but not large enough to slide over said front bindings or said rear bindings, said lock requiring a key to open, and a second fixed, closed loop coupled to a second end of said intermediate flexible substrate opposite said first end;

instructing a person to wrap said intermediate flexible substrate around said anchor object, to pass said first loop through said second loop to create a secondary loop encircling said anchor object, and to lock said first loop around said pair of skis between said front bindings and said rear bindings, thereby securing said pair of skis to said anchor object.

16. The method of claim 15, further comprising instructing said person to lock said first loop around a pair of skis too large to pass through said second loop.

17. The method of claim 15, wherein:

said lock comprises a combination lock; and said key is the combination to said lock.

18. The method of claim 1, wherein:

said intermediate flexible substrate has a length defined by a distance between said first loop and said second loop along said intermediate flexible substrate;

each ski of said pair of skis has a length defined by a distance between a front tip of said ski and a rear edge of said ski; and said length of said intermediate substrate is less than one-half said length of a ski of said pair of skis.

19. The method of claim 15, wherein:

said intermediate flexible substrate has a length defined by a distance between said first loop and said second loop along said intermediate flexible substrate;

each ski of said pair of skis has a length defined by a distance between a front tip of said ski and a rear edge of said ski; and said length of said intermediate substrate is less than one-half said length of a ski of said pair of skis.

* * * * *